US006093475A

United States Patent [19]

Geller

[11] Patent Number: 6,093,475

[45] Date of Patent: Jul. 25, 2000

[54] BLEEDING COSTUME ELEMENT

[75] Inventor: Alan Geller, Sea Cliff, N.Y.

[73] Assignee: Easter Unlimited Inc., Carle Place, N.Y.

[21] Appl. No.: 09/175,071

[22] Filed: Oct. 19, 1998

[51] Int. Cl.[7] ..... B32B 3/00

[52] U.S. Cl. ..... 428/166; 428/13; 428/321.5; 2/9; 2/206; 2/424; 2/464

[58] Field of Search ..... 428/321.5, 13, 428/166; 2/464, 424, 9, 206

[56] References Cited

U.S. PATENT DOCUMENTS 46,902 3/1865 Hawkins .

2,295,279 9/1942 Andrews ..... 2/174

4,800,592 1/1989 Cable ..... 2/69

5,396,881 3/1995 Klein ..... 601/23

5,546,604 8/1996 Geller ..... 2/202

*Primary Examiner*—William Krynski

*Assistant Examiner*—B. Shewareged

*Attorney, Agent, or Firm*—Stroock & Stroock & Lavan LLP

[57] ABSTRACT

A costume element having an inner layer and an at least in part transparent outer layer forming a passage therebetween, the passage having an upper opening. A fluid visible in at least a part of the passage is injected into the passage through the upper opening. A lower opening to the passage can be coupled to the upper opening by one or more tubes providing fluid communication and a pump.

29 Claims, 4 Drawing Sheets

FIG. 1
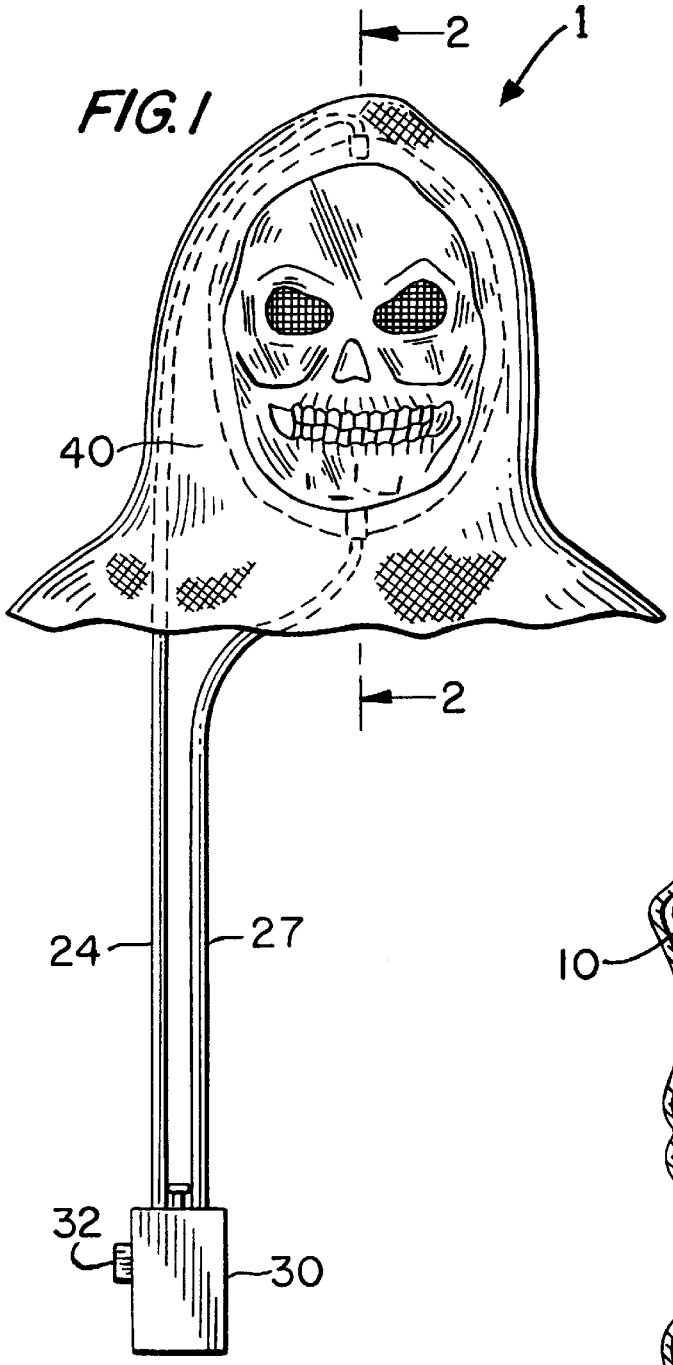
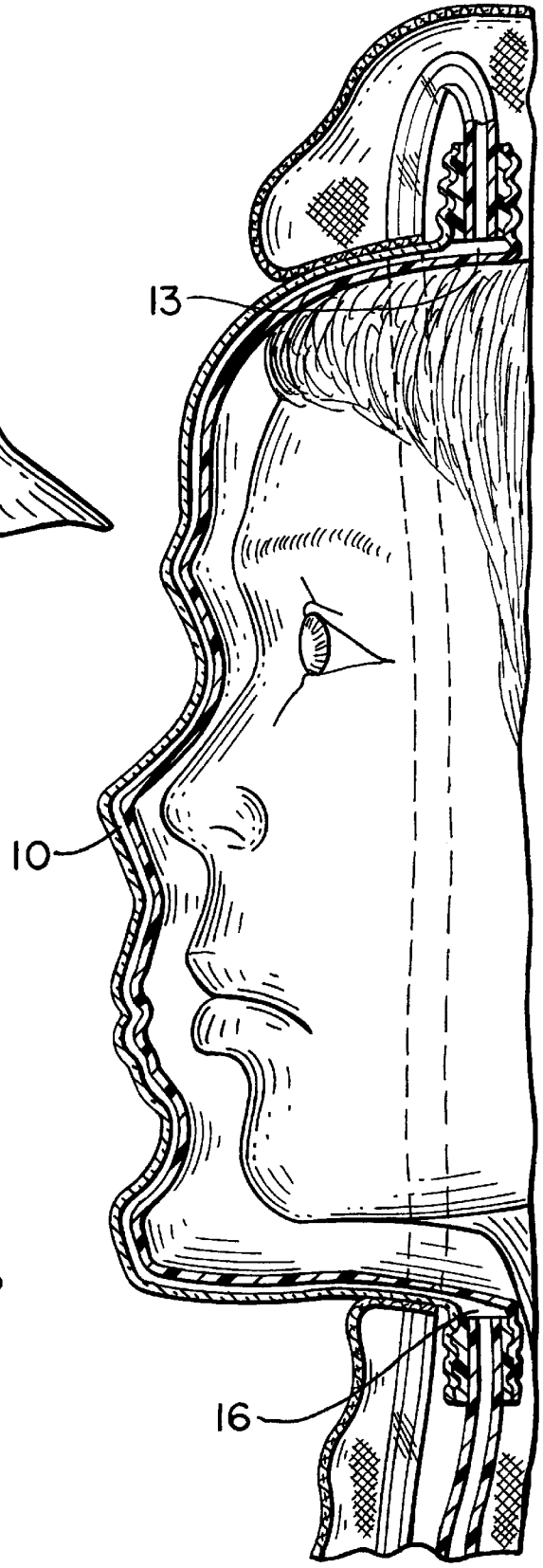
FIG. 2

FIG. 3
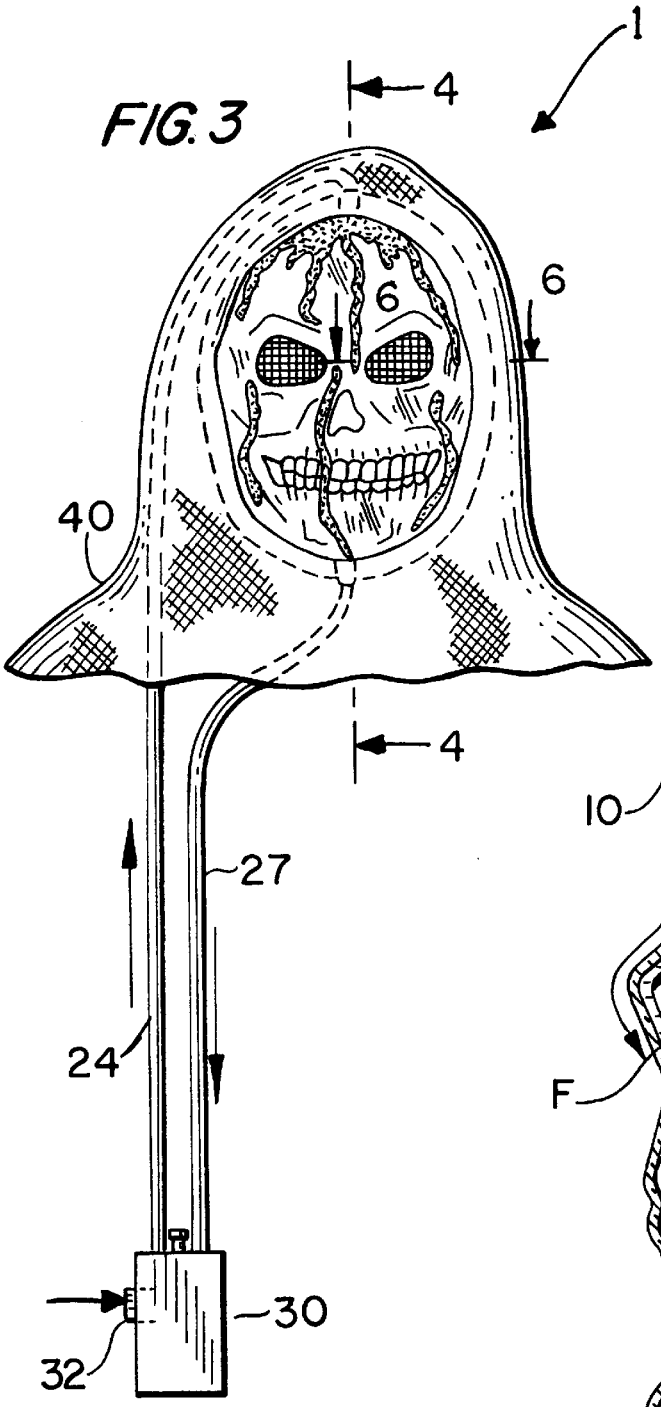
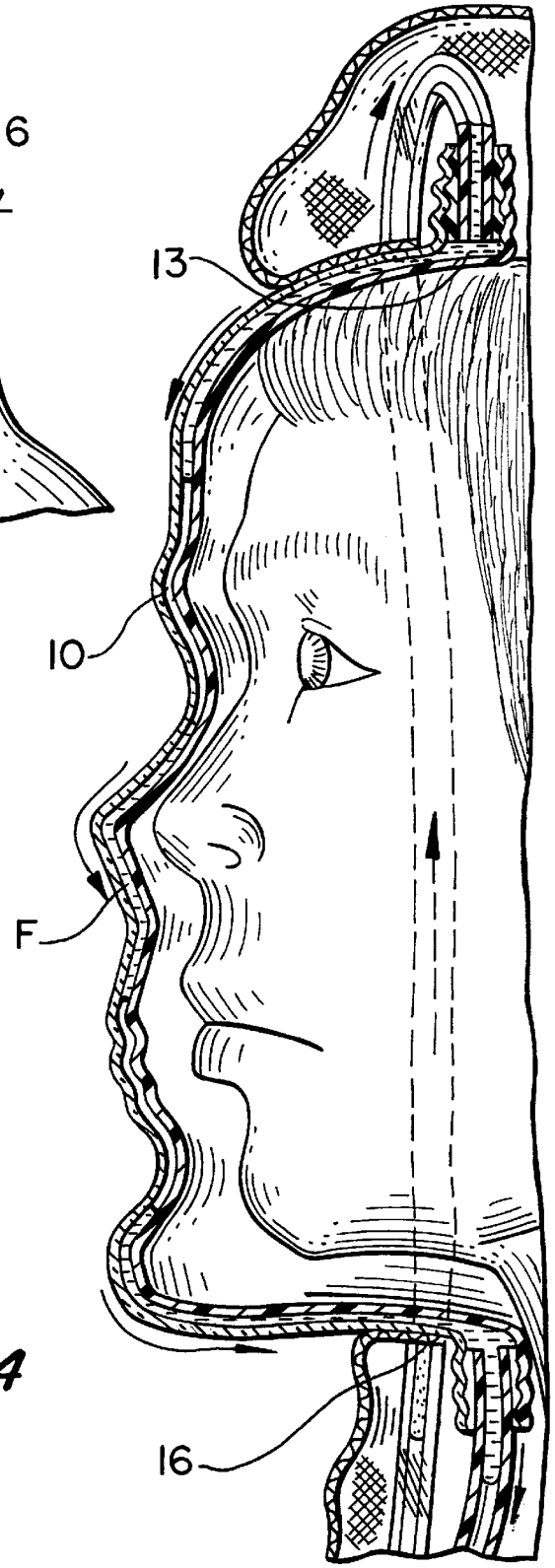
FIG. 4

BLEEDING COSTUME ELEMENT

BACKGROUND OF INVENTION

This invention relates to a costume element and in particular a costume element suitable for use representing a bleeding body part as a part of a costume for Halloween and other circumstances where costumes are employed.

Children and adults enjoy wearing costumes. This is especially so on Halloween when people often dress up as ghosts, monsters, skeletons and other similar characters and get pleasure out of scaring or entertaining people. A central feature of a Halloween costume is the mask which disguises the wearer's identity and usually includes many of the gory and scary features of the character. Generally, the more frightening the mask, the more fun people will have wearing the costume and scaring people. Also, as is well known, costumes are not limited to masks and it is desirable to produce bleeding body parts aside from the face.

A drawback of most existing Halloween masks and other costume elements is that they generally do not include a way to modify and/or add to the frightening effect of the mask. As a result, after the mask or other costume element is initially viewed, there is nothing more the wearer can do to further frighten or entertain the viewers. Also, because the features of prior art of most Halloween masks and other costume elements are generally fixed, the wearer can become quickly bored with them.

Accordingly, it is desirable to provide a bleeding costume element that overcomes these deficiencies resulting in a product with increased play and entertainment value.

SUMMARY OF THE INVENTION

The present invention relates to a bleeding costume element in which the wearer can selectively increase the frightening or entertaining effect of the element, thus increasing the element's play and entertainment value. A bleeding costume element made in accordance with the present invention includes an inner layer which may or may not be transparent and an at least partially transparent outer layer with a passage formed therebetween. At the top of the passage there is an upper opening with one end of an injection tube inserted therein. At the bottom of the passage there is a lower opening with one end of a return tube inserted therein. The second ends of the injection tube and return tube are connected to a fluid pump that contains a red blood-like fluid or any other fluid capable of producing a desired effect. When the fluid pump is activated, the fluid is pumped into the passage via the injection tube and upper opening. The fluid flows through the passage where it is visible through the transparent outer layer.

Accordingly, it is the object of the present invention to provide a bleeding costume element with increased play and entertainment value.

Another object of the invention is to provide a bleeding costume element that enables the wearer to selectively increase the visual effect of the element.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a front view of the mask constructed in accordance with the present invention;

FIG. 2 is a side cross-sectional view of the mask of FIG. 1 along line 2—2;

FIG. 3 is a front view of the mask of FIG. 1 showing fluid through the channel;

FIG. 4 is a side cross-sectional view of the mask of FIG. 3 along line 4—4;

DETAILED DESCRIPTION OF THE PREFERRED EMBODIMENTS

Figures 5, 6:
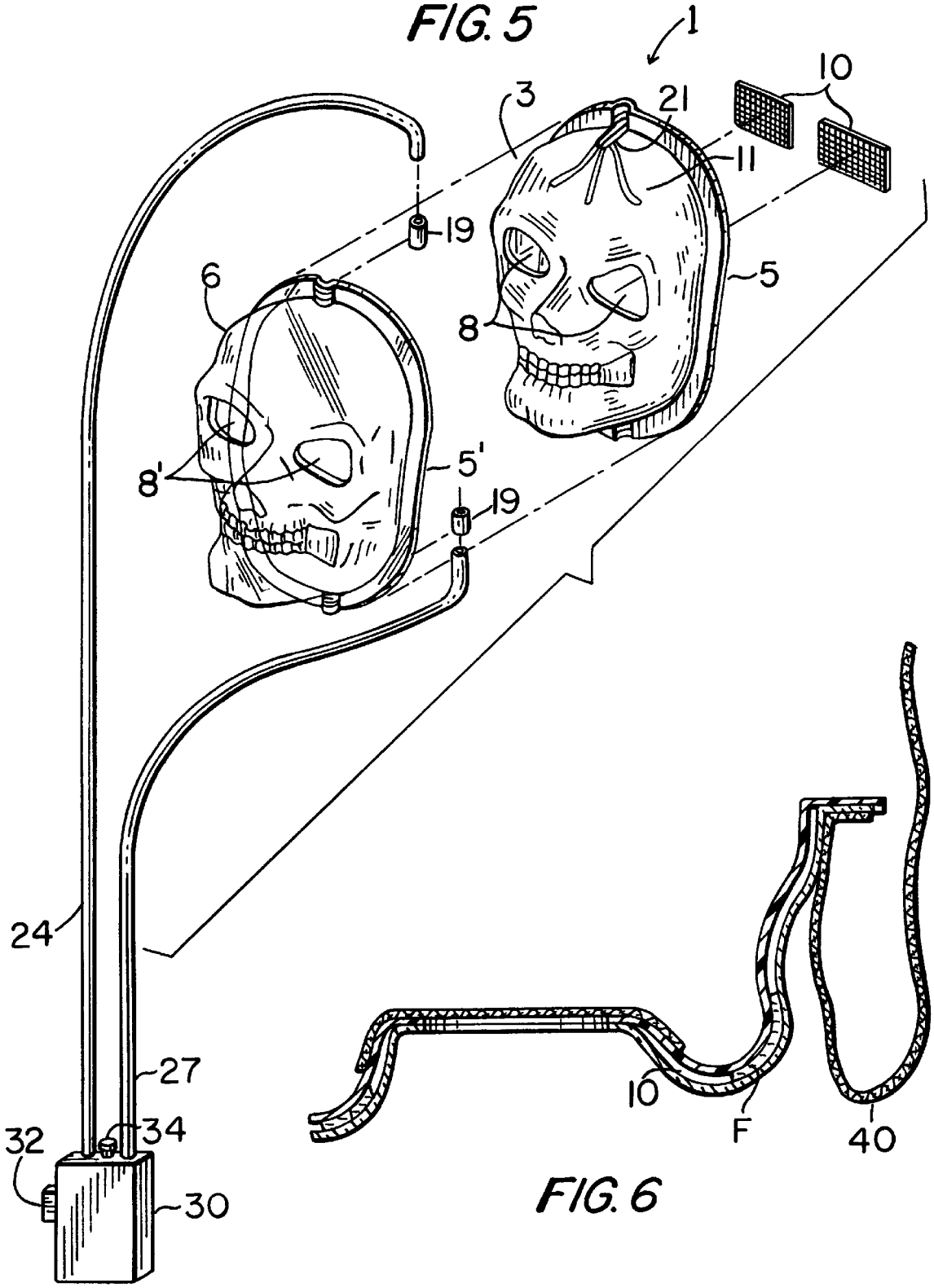
FIG. 5 is an exploded perspective view of the mask of FIG. 1.
FIG. 6 is a top cross-sectional view of FIG. 3 along line 6—6.

Referring now to FIGS. 1–6, there is shown a mask 1 constructed in accordance with the present invention. Mask 1 includes an inner layer 3, preferably constructed from a light weight, moldable material, such as plastic. Formed along the perimeter of inner layer 3 is an outer lip 5. Inner layer 3 may be shaped and molded to portray any desired facial characteristics. For example, in an exemplary embodiment particularly suitable for use as a Halloween mask, inner layer 3 is shaped to depict the distinctive features of a skull including sunken eye sockets, open nose orifice and exposed teeth. Alternatively, inner layer 3 may be shaped to depict any human, animal or other image. Preferably, inner layer 3 is opaque so that mask 1 conceals the identify of the wearer. However, the inner layer can be totally or in part transparent to create desired effects in conjunction with a totally or partially transparent outer layer 6 more particularly described below. Inner layer 3 includes a pair of eye openings 8 for enabling the wearer to see out of mask 1. In a preferred embodiment, each of openings 8 are covered with an eye covering 100 constructed from a mesh material. Preferably, the mesh material will have a pore size large enough so the wearer can see through eye covering 100 but small enough so that one observing mask 1 from a distance will not easily see the eyes of the wearer thereby further hiding the identify of the wearer and enhancing the desired frightening effect. Furthermore, if mask 1 is shaped to depict a skull, using eye coverings 10 made from a black mesh material is preferred because it makes the skull appear more realistic thereby increasing the frightening effect of mask 1. However, use of a mesh material in the eye sockets is not required.

Mask 1 also includes an outer layer 6 that is preferably constructed from a lightweight, moldable material, such as plastic. In an exemplary embodiment the outer layer is transparent, but, as noted above, it may be all or partially transparent in coordination with inner layer 3 to create desired effect. Formed along the perimeter of outer layer 6 is an outer lip 5'. Outer layer 6 is shaped and molded in substantially the same manner as inner mask layer 3. For example, in the exemplary embodiment described above, outer layer 6 is shaped to include substantially the same skull features included in inner layer 3. Outer layer 6 also includes a pair of eye openings 8'. Outer layer 6 is sized so that when outer layer 6 is stacked on top of inner layer 3, a passage 10 is formed therebetween.

Outer layer 6 and inner layer 3 are joined together by sealing outer lip 5 to outer lip 5' and the interior edge of eye sockets 8 to interior edge of eye sockets 8'. While the preferred sealing method is heat sealing, any sealing method which results in a liquid impermeable seal may be used. Thus, by sealing outer layer 6 to inner layer 3 in this fashion, passage 10 is delimited by sealed outer lips 5 and 5' and sealed interior edges of eye sockets 8 and 8'. (See FIG. 6) If desired, passage 10 can occupy a selected smaller area of the mask by being defined by selected additional seal lines, the relative dimensions of the inner and outer layers to define the space therebetween or additional inner layers (the least desirable choice because of increased choice).

At the top of mask 1, an upper opening 13 is formed through outer lips 5 and 5' so as to be in fluid communication with passage 10. A tube holder 19 is inserted into upper opening 13. A channel 21, in fluid communication with upper opening 13, extends part of the way down the upper center portion of inner layer 3. A plurality of grooves 11 are in fluid communication with channel 21 and branch out and down across the forehead of inner layer 3.

At the bottom of mask 1, a lower opening 16 is formed through outer lips 5 and 5' so as to be in fluid communication with passage 10. Tube holder 19 is inserted into lower opening 16.

An injection tube 24, preferably made of a flexible material such as plastic, has one end inserted into tube holder 19 of upper opening 13 and the other end connected to a fluid pump 30. A return tube 27, also preferably made of a flexible material such as plastic, has one end inserted into tube holder 19 of lower opening 16 and the other end connected to fluid pump 30. Thus fluid pump 30 is in fluid communication with upper opening 13 through injection tube 24 and is in fluid communication with lower opening 16 through return tube 27.

Fluid pump 30 includes an opening that is selectively sealable with a stopper 34 and is used to introduce a fluid F into fluid pump 30. Fluid pump 30 also includes a pump button which pressurizes fluid F stored in fluid pump 30 and then ejects fluid F out of fluid pump 30 and into insertion tube 24. Fluid pump 30 also receives fluid F from return tube 27. In an exemplary embodiment, fluid pump 30 is a lightweight, hand-held and concealable so that it can be easily carried by the wearer and operated without detection. Other forms of pumps can be used such as a peristaltic pump mounted on a single tube.

Referring now to FIGS. 3–4, the operation of mask 1 will now be described. First, fluid F is inserted into fluid pump 30 through the opening and is sealed with stopper 34. In an preferred embodiment, fluid F is selected to be red and have a blood-like appearance. An example of such fluid F is theatrical blood that is used by actors to simulate bleeding. However, fluid F can have any desired color or consistency to create any desired effect. Pump button 32 is then pressed thereby creating pressure inside fluid pump 30 and causing fluid F to be ejected out of fluid pump 30 and into passage 10 via injection tube 24 and upper opening 13. Upon entering passage 10, fluid F enters channel 21 and is guided down the center of inner layer 3 by channel 21. Fluid F is then distributed across the forehead of inner layer 3 by grooves 11. Fluid F then trickles down through passage 10 across the skull features of mask 1. Because fluid F is visible through transparent outer layer 6, fluid F gives the appearance of blood trickling down the skull features of mask 1 thereby creating a realistic bleeding effect.

After flowing down through passage 10, fluid F drains towards the bottom of passage 10 and exits passage 10 through lower opening 16. Fluid F then reenters fluid pump 30 via return tube 27. Once fluid F returns to fluid pump 30, pump button 32 may be pressed again to repeat the dripping blood effect. Alternatively, there may be provided sufficient fluid F so that a continuous flow of fluid F would result upon repeated pressing of pump button 32.

In a preferred embodiment, shroud 40 which may be of any color, for example black, is attached to outer lips 5 and 5' and extends down to shoulders of the wearer. Shroud 40 serves to cover insertion tube 24, upper opening 13, return tube 27 and lower opening 16 so that the source of fluid F and the operation of mask 1 is concealed. In this way, the introduction of "blood" into passage 10 will more likely surprise those viewing mask 1. Also, the use of shroud 40 enhances the overall frightening effect of mask 1. The pump can be concealed beneath the wearer's clothing or in a pocket, enhancing the effect of use of the mask.

Figure 7:
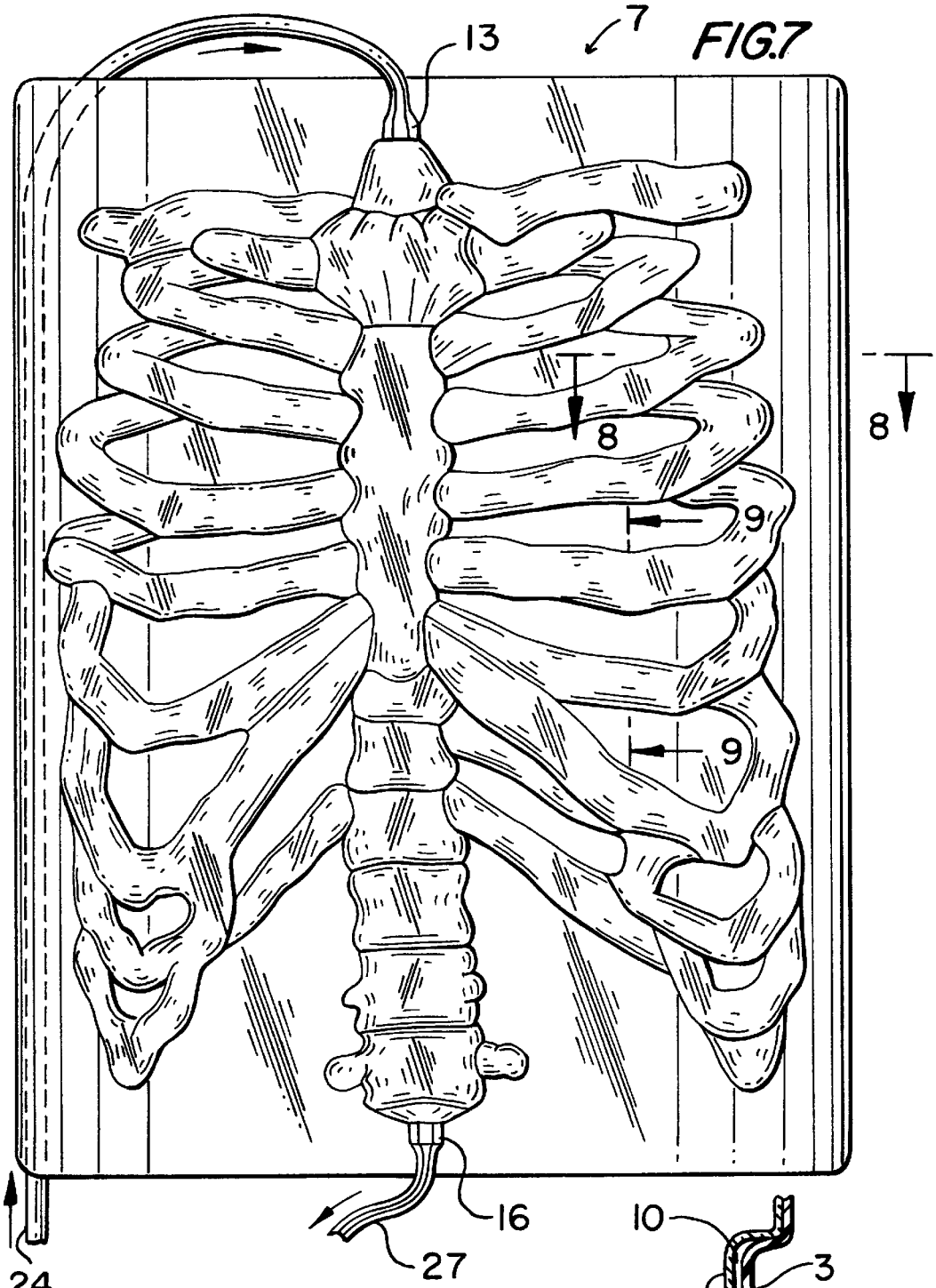
FIG. 7 is a front view of a bleeding costume element in the form of a breastplate constructed in accordance with an alternative embodiment of the present invention.
Figure 8:
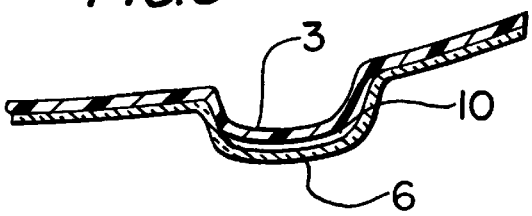
FIG. 8 is a top cross-sectional view of the costume element of FIG. 7 along line 8—8.
Figure 9:
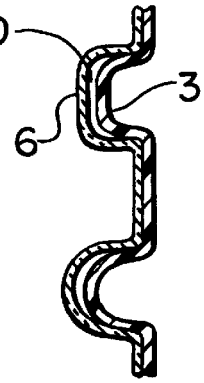
FIG. 9 is a side cross-sectional view of the costume element of FIG. 7 along lines 9—9.

Although a mask shaped as a skull has been described, a costume element made in accordance with the present invention can be shaped to depict any object, including, but not limited to, any human, animal or monster body part. For example, in FIGS. 7–9, there is shown a bleeding costume element 71 made in accordance with an alternative embodiment of the present invention that is shaped in the form of a breastplate depicting skeletal human ribs. Elements of mask 71 that are the same as elements contained in costume element 1 are identically numbered and a detailed description thereof will be omitted.

Costume element 71 is constructed from inner layer 3 shaped as a set of human ribs and a transparent outer layer 6 shaped in a corresponding manner and attached to inner layer 3 so as to form passage 10 therebetween. In operation of costume element 71, fluid F is injected by a fluid pump (not shown) into insertion tube 24 that is connected to upper opening 13. Fluid F enters upper opening 13, trickles down through passage 10 and is visible through transparent outer layer 6 thereby creating a frightening effect.

Accordingly, a bleeding costume element in which the wearer can selectively add to the frightening and entertaining effect of the costume element is achieved. By pressing pump button 30, wearer can create the realistic appearance of blood dripping down the front of a costume element thereby increasing the frightening and entertaining effect of costume element 1. Because the frightening and/or entertaining effect of a costume element is selectively controlled by the wearer, the play value of costume element 1 is increased.

It will thus be seen that the objects set forth above, and those made apparent from the preceding description, are efficiently attained and, because certain changes may be made in the above construction without departing from the spirit and scope of the invention, it is intended that all matter contained in the above description or shown in the accompanying drawings shall be interpreted as illustrative and not in a limiting sense.

What is claimed is:

1. A costume element comprising:

an inner layer and an at least in part transparent outer layer, at least one of said layers being shaped to define a simulation of a part of a body, said layers being further shaped to form a passage therebetween, said passage having an opening, and a fluid, said fluid being injected into said passage through said opening to as to be visible through a transparent portion of said outer layer.

2. The costume element in claim 1 where the color of said fluid has a blood-like appearance.

3. The costume element of claim 1, wherein said passage formed by said inner and outer layers has a second opening in fluid communication with said first-mentioned opening, said fluid flowing between said openings when injected into said first-mentioned opening.

4. The costume element of claim 1, wherein said inner layer and said outer layer are joined at least in part by a liquid impermeable seal.

5. The costume element of claim 4, wherein said seal at least in part defining said passage.

6. The costume element of claim 1, wherein said inner layer and said outer layer are shaped to appear like a skull and said costume element is a mask.

7. The costume element of claim 6, further comprising a shroud coupled to one or both of said inner and outer layers, said shroud covering said upper opening and said lower opening.

8. The costume element of claim 1, further comprising a channel disposed on one of said inner or outer layers and in fluid communications with said upper opening for channeling said fluid through said passage.

9. The costume element of claim 8, further comprising a plurality of grooves disposed on one of said inner or outer layers and in fluid communication with said channel for distributing said fluid across all or a part of said inner layer.

10. The costume element of claim 1, wherein at least a part of said inner layer is opaque for concealing a part of a wearer.

11. The costume element of claim 1, wherein said inner layer and said outer layer define a mask and include a pair eye openings.

12. The costume element of claim 11, wherein each of said eye openings are covered by an eye covering.

13. The costume element of claim 12, wherein said eye covering is constructed from a mesh having a pore size sufficiently large for allowing the wearer to see through said eye covering and sufficiently small for concealing the eyes of the wearer.

14. The costume element of claim 1, wherein said inner and said outer layers are shaped to define a desired image.

15. The costume element of claim 1, wherein said inner and said outer layer layers are shaped to appear like a set of ribs.

16. The costume element in claim 3 further comprising:

a fluid pump;

an injection tube portion having a first end and a second end, the first end of said injection tube portion being connected to said first-mentioned opening and the second end of said injection tube portion being connected to said fluid pump;

a return tube portion having a first end and a second end, the first end of said return tube portion being connected to said second opening and the second end of said return tube portion being connected to said fluid pump; and wherein said fluid pump propels said fluid into said first-mentioned opening of said passage through said injection rube and said fluid exits said passage through said second opening and returns to said fluid pump through said return tube.

17. The costume element of claim 16, wherein said fluid pump is hand-held and concealable so as to be easily operated and concealable.

18. The costume element in claim 3, wherein said first-mentioned opening is positioned above said second opening in said costume element.

19. The costume element in claim 3, where the color of said fluid has a blood-like appearance.

20. The costume element of claim 3, wherein said inner layer and said outer layer are joined at least in part by a liquid impermeable seal.

21. The costume element of claim 20, wherein said seal at least in part defining said passage.

22. The costume element of claim 3, wherein said inner layer and said outer layer are shaped to appear like a skull and said costume element is a mask.

23. The costume element of claim 22, further comprising a shroud coupled to one or both of said inner and outer layers, said shroud covering said upper opening and said lower opening.

24. The costume element of claim 3, wherein at least a part of said inner layer is opaque for concealing the face of a wearer.

25. The costume element of claim 3, wherein said inner layer and said outer layer define a mask and include a pair eye openings.

26. The costume element of claim 23, wherein each of said eye openings are covered by an eye covering.

27. The costume element of claim 26, wherein said eye covering is constructed from a mesh having a pore size sufficiently large, for allowing the wearer to see through said eye, covering and sufficiently small for concealing the eyes of the wearer.

28. The costume element of claim 1, wherein said inner and said outer layers are shaped too define a desired image.

29. The costume element of claim 3, wherein said inner and said outer layer layers are shaped to appear like a set of ribs.

* * * * *